United States Patent [19]

Lowery

[11] 4,099,734

[45] Jul. 11, 1978

[54] SKATEBOARD BRAKE

[76] Inventor: Fred Lowery, P.O. Box 1183, Pebble Beach, Calif. 93953

[21] Appl. No.: 797,125

[22] Filed: May 16, 1977

[51] Int. Cl.[2] ..... A63C 17/14

[52] U.S. Cl. ..... 280/11.2; 188/5; 280/87.04 A

[58] Field of Search ..... 188/5, 6, 8, 20, 23; 280/11.2, 11.21, 87.04 R, 87.04 A

[56] References Cited

U.S. PATENT DOCUMENTS

| | | | |
|---|---|---|---|
| 1,050,490 | 1/1913 | Schwarz | 280/11.2 |
| 1,933,973 | 11/1933 | French | 188/5 |
| 2,051,762 | 8/1936 | Vincent | 280/87.04 R |
| 2,200,935 | 5/1940 | Rodriguez | 188/5 |
| 3,288,251 | 11/1966 | Sakwa | 280/11.2 |
| 3,385,608 | 5/1968 | Waddell | 280/11.2 |
| 4,037,852 | 7/1977 | Bayer et al. | 280/11.2 |
| 4,043,566 | 8/1977 | Johnson | 188/5 |

FOREIGN PATENT DOCUMENTS

| | | | |
|---|---|---|---|
| 497,886 | 12/1938 | United Kingdom | 188/5 |

*Primary Examiner*—Edward R. Kazenske
*Attorney, Agent, or Firm*—Harris Zimmerman

[57] ABSTRACT

A skateboard brake includes a heavy brush disposed below the skateboard and secured to a support bracket which is pivotally joined to a lower forward portion of the skateboard. The support bracket extends behind the rear wheels of the skateboard, and a plunger extends vertically from the support bracket through a slot in the rear end of the skateboard. The support bracket is resiliently biased upwardly to maintain the brush out of engagement with the pavement. A pedal is provided on the upper rear portion of the skateboard superjacent to the plunger, so that the skateboard rider may step on the brake, pedal and thereby force the plunger downwardly, the support bracket pivoting on the forward pivot and urging the brush into frictional engagement with the pavement.

3 Claims, 5 Drawing Figures

SKATEBOARD BRAKE

BACKGROUND OF THE INVENTION

In recent years, the skateboard has come to the fore as a means of recreation and outdoor exercise. The skateboard combines the thrill of speed with a test of skill to provide great pleasure to the skateboard rider.

Skateboards have also been responsible for a great number of injuries to the skateboard rider, and the sport has gained a deserved reputation for risk and danger. Generally speaking, skateboarding is accomplished on a downwardly sloping, paved surface. The skateboard rider can control the speed of the skateboard by performing generally S-shaped turns which intersect the fall line of the downward slope. As the skateboard gains speed, the turns become more and more difficult to accomplish, and the level of riding skill required to stay on the skateboard increases as quickly as the speed of the board.

Once the speed of the skateboard becomes so great that the rider cannot safely turn, the skateboard is out of control. The rider is then forced to dismount the skateboard, virtually instantaneously changing from a stationary position on the board to sprinting along the downhill slope. It is at this point that many skateboard riders fall and suffer injuries.

There are no safe braking devices known in the prior art for use with skateboards. If a braking device were provided, the skateboard rider could maintain the speed of the skateboard within a safe limit consistent with the skill of the rider.

SUMMARY OF THE PRESENT INVENTION

The present invention generally comprises a brake for use with a skateboard to selectively control the speed of the skateboard. The brake apparatus includes a pivot secured to the undersurface of the skateboard behind the front wheels thereof, and a support bracket vertically pivotable about the pivot. A heavy duty brush which is adapted to engage the pavement is secured to the support bracket, the brush being disposed in an area defined approximately by the mid-point of the skateboard and the rear wheels of the skateboard.

The support bracket includes a flared rear portion which generally circumscribes the rear wheel mount of the skateboard, and a plunger extends vertically from the rear portion of the support bracket. A slot disposed in the rear end of the skateboard receives the plunger in vertically translatable fashion. A brake pedal is joined to the rear upper surface of the skateboard and is adapted to impinge on the upper end of the plunger. Also, resilient means are provided to bias the support bracket upwardly and maintain the brush out of engagement with the pavement.

As the skateboard rider is proceeding along a paved surface, he or she may actuate the brake by stepping on the brake pedal and forcing the plunger to translate downwardly. The plunger thus causes the support bracket to pivot downwardly about the forward pivot, carrying the brush into engagement with the pavement. The frictional effect of the brush on the pavement will slow the skateboard to a degree determined by the force applied to the brake pedal. The skateboard rider is thus able to control the progress and acceleration of the skateboard and maintain the speed thereof within a safe limit determined by the ability of the skateboard rider.

A BRIEF DESCRIPTION OF THE DRAWINGS

DESCRIPTION OF THE PREFERRED EMBODIMENT

Figure 1:
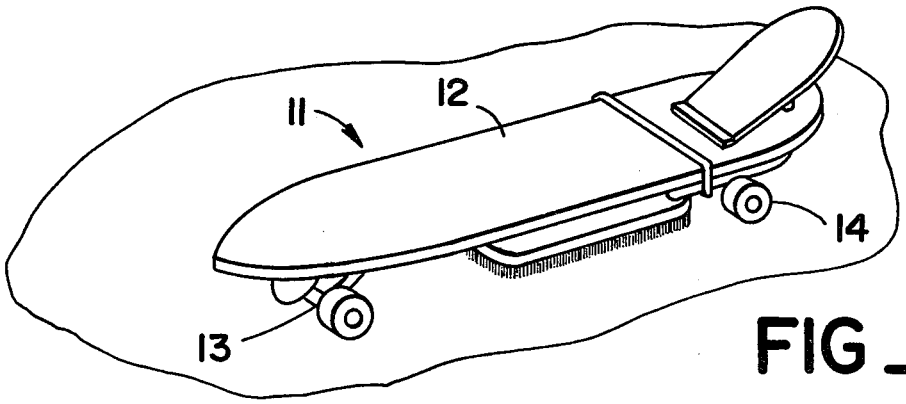
FIG. 1 is a perspective view of a skateboard with the brake of the present invention mounted thereon.
Figure 2:
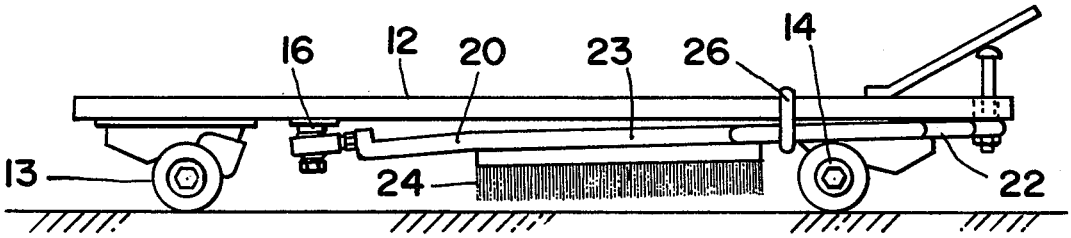
FIG. 2 is a side elevation of the skateboard brake of the present invention, shown mounted on a typical skateboard.
Figure 3:
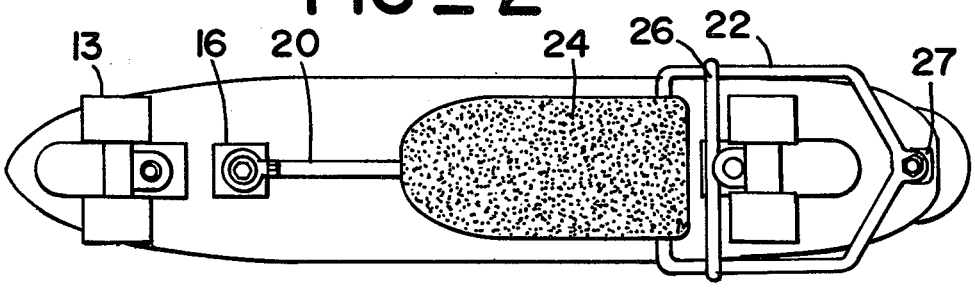
FIG. 3 is a bottom view of the skateboard brake of the present invention, shown in the setting of FIG. 2.

The skateboard brake of the present invention is adapted to be used with a skateboard 11, as shown in FIG. 1, although the skateboard itself forms no part of the invention. The typical skateboard 11 includes a platform 12, a forward wheel truck 13, and a rear wheel truck 14. The nature of the wheel trucks and their mounting on the platform 12 are well known in the art, and need not be described herein.

Figure 4:
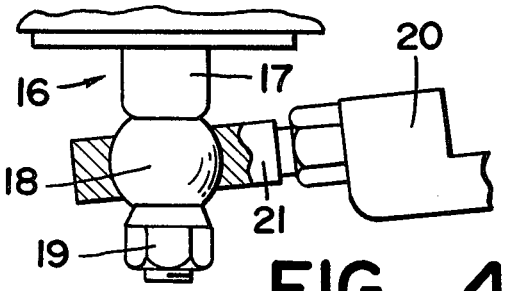
FIG. 4 is a detailed side view of the front pivot of the skateboard brake of the present invention.

The skateboard brake includes a forward pivot 16 which is secured to the underside of the platform 12 directly behind the mounting bracket of the forward wheel truck 13. As shown in FIG. 4, the forward pivot 16 includes a ball portion 18 which depends from a shank portion 17 joined to the platform 12. The lower end of the pivot includes a threaded portion on which a nut 19 is secured.

The brake apparatus includes a longitudinally extending support bracket 23, which is provided with a forward tongue portion 20. Extending from the forward end of the tongue 20 is a collar 21 as shown in FIG. 4. The collar is secured about the ball portion 18 of the pivot 16. The nut 19 secures the collar about the ball, and permits the bracket 23 a limited degree of vertical pivotting motion about the ball 18. Joined to the main portion of the support bracket 23 is a heavy duty brush 24 having the bristles thereof extending downwardly toward the floor or pavement. The brush 24 is adapted to impinge on the pavement or other surface on which the skateboard is travelling, and to provide frictional engagement therewith.

The rear portion 22 of the support bracket is formed of rod or tubing which describes a generally rectangular shape circumscribing the rear wheel truck 14. The rearmost portion of the support bracket is provided with a threaded hole 31, and a plunger 28 is secured in the threaded hole 31. The rear end of the skateboard is provided with a slot 27 through which the plunger 28 extends.

An elastic band 26 is secured about both the rear portion 22 of the support bracket and the platform 12 of the skateboard to resiliently bias the bracket upwardly and to maintain the brush 24 out of impingement with the pavement. It may be appreciated that other resilient or spring means may be used to bias the support bracket upwardly. A brake pedal 29 is joined to a rear portion of the platform 12, and is disposed so that a portion of the brake pedal impinges on the upper end of the plunger 28.

Figure 5:
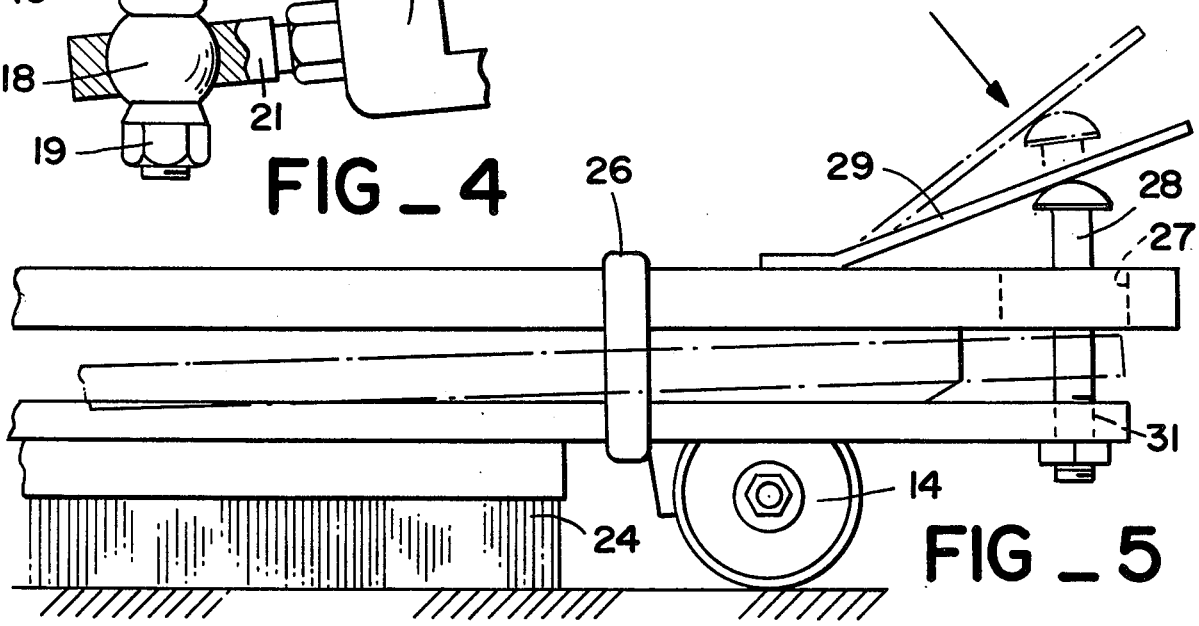
FIG. 5 is a detailed side view of the plunger portion of the skateboard brake of the present invention.

With the skateboard brake of the present invention in the unactuated position, the rear portion of the support bracket is disposed directly subjacently to the platform 12, and the plunger 28 extends to its utmost through the slot 27. This is shown in phantom line in FIG. 5. To actuate the skateboard brake, the pedal 29 is depressed by the skateboard rider, driving the plunger 28 downwardly through the slot 27. This is shown in black line in FIG. 5. As the plunger descends, it forces the support bracket to pivot about the forward pivot 16 and against the resilient force of the elastic band 26. The brush 24 is thus carried into engagement with the pavement, causing a great amount of drag. This drag is sufficient to slow the skateboard.

It should be noted that as greater force is applied to the pedal 29 and the plunger 28, the frictional engagement of the brush 24 with the pavement will increase. Thus the skateboard rider can control the amount of drag which is slowing the skateboard, and can easily maintain the skateboard within the desired speed limits.

It should be noted that the majority of the brush 24 is disposed behind the centerpoint of the skateboard, as defined by the mid-point of the wheel trucks 13 and 14. Thus the drag effect of the brush 24 acts at a virtual point which is behind the center of mass of the skateboard, and the drag force thus cannot destabilize the skateboard.

It should also be noted that it is within the scope of the present invention to reverse the orientation of the braking device with respect to the skateboard. That is, the pedal could be provided at the front end of the skateboard, and the pivot for the support bracket could be provided at the rear portion of the skateboard.

I claim:

1. A braking device for a skateboard having front and rear wheel assemblies, comprising friction means adapted to frictionally engage the surface on which said skateboard travels, said friction means extending below and along a substantial longitudinal extent of said skateboard, a bracket secured to said friction means subjacently of said skateboard, a ball pivot secured to a forward portion of said skateboard adjacent said front wheel assembly and depending downwardly therefrom, a collar secured to a forward end of said bracket and engaging said ball pivot to permit rotation of said bracket and said friction means in a vertical plane, a portion of said friction means being disposed forwardly of the longitudinal midpoint of said skateboard, a rear portion of said bracket circumscribing said rear wheel assembly and a plunger extending upwardly therefrom; a slot in a rear portion of said skateboard through which said plunger extends freely, a pedal secured to a rear portion of the upper surface of said skateboard, said pedal having a free end impinging on the upper end of said plunger, and resilient means secured to said skateboard and said bracket for biasing said bracket, friction means, plunger, and pedal upwardly.

2. The braking device of claim 1, wherein said friction means includes a brush having bristles directed downwardly toward said surface.

3. The braking device of claim 1, wherein said resilient means includes an elastic band secured about said bracket and said skateboard.

* * * * *